US011204171B2

(12) United States Patent
Braden et al.

(10) Patent No.: US 11,204,171 B2
(45) Date of Patent: Dec. 21, 2021

(54) COOKING PERFORMANCE FIN FOR COOKING APPLIANCE

(71) Applicants: BSH Home Appliances Corporation, Irvine, CA (US); BSH Hausgeräte GmbH, Munich (DE)

(72) Inventors: Ben Braden, Lafollette, TN (US); Ian McIver, Knoxville, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 156 days.

(21) Appl. No.: 16/792,333

(22) Filed: Feb. 17, 2020

(65) Prior Publication Data

US 2021/0254833 A1 Aug. 19, 2021

(51) Int. Cl.
*F24C 3/02* (2006.01)
*F24C 15/00* (2006.01)
*F24C 15/32* (2006.01)

(52) U.S. Cl.
CPC ..... *F24C 3/025* (2013.01); *F24C 15/007* (2013.01); *F24C 15/32* (2013.01)

(58) Field of Classification Search
CPC ..... F24C 15/32; F24C 15/02; F24C 15/007; F24C 15/008; F24C 15/085
See application file for complete search history.

(56) References Cited

U.S. PATENT DOCUMENTS

| | | | | |
|---|---|---|---|---|
| 5,816,234 | A * | 10/1998 | Vasan | F24C 15/322 126/21 A |
| 6,101,930 | A | 8/2000 | Van Over | |
| 7,105,778 | B1 | 9/2006 | Delong et al. | |
| 8,770,180 | B2 * | 7/2014 | Kim | F24C 15/322 126/21 R |
| 9,593,856 | B2 | 3/2017 | Paller et al. | |
| 2009/0178665 | A1 | 7/2009 | Weber et al. | |
| 2018/0051891 | A1 * | 2/2018 | Diggins | F24C 15/322 |

FOREIGN PATENT DOCUMENTS

JP H11182854 A 7/1999

* cited by examiner

*Primary Examiner* — David J Laux
*Assistant Examiner* — Nikhil P Mashruwala
(74) *Attorney, Agent, or Firm* — Michael E. Tschupp; Andre Pallapies; Brando G. Braun

(57) ABSTRACT

A domestic cooking appliance for heating a food item includes a main housing; a cooking compartment in the main housing, the cooking compartment being configured to receive the food item to be heated, the cooking compartment having a first sidewall and a second sidewall; a gas burner that provides heat to the cooking compartment; a burner panel located between the gas burner and the cooking compartment; and a first fin protruding from the first sidewall and into the cooking compartment.

3 Claims, 7 Drawing Sheets

COOKING PERFORMANCE FIN FOR COOKING APPLIANCE

FIELD OF THE INVENTION

The invention is directed to a domestic cooking appliance. More particularly, embodiments of the invention are directed to a cooking appliance having a heating compartment that is heated by a gas burner.

An example of an application for the invention is a domestic kitchen gas oven having one or more gas burners located below a panel at the bottom of a cooking compartment of the oven. Fins protruding from interior side walls of the cooking compartment redirect heated air away from the sides of the cooking compartment and toward the item being heated.

BACKGROUND OF THE INVENTION

Some modern domestic kitchens include cooking appliances such as ovens and ranges that have a gas burner located in the bottom of a cooking compartment and below a panel. Air inside the cooking compartment is heated by the gas burner and passes through the panel at openings in the panel adjacent the sides of the cooking compartment.

Applicants recognized an improvement to the above arrangement and implement that improvement in embodiments of the invention.

SUMMARY

The invention achieves the benefit of improving circulation of heated air inside the cooking compartment of a gas cooking appliance by providing fins on the interior side walls of the cooking compartment.

Some cooking appliances heat air inside a cooking compartment by burning a gas with one or more gas burners. Some of these appliances locate the gas burner below a panel that deflects the heated air to the sides of the cooking compartment. The panel is often provided with openings at or near the side walls of the cooking compartment to allow the heated air to pass through the panel and into the cooking compartment in order to heat a food item in the cooking compartment.

Embodiments of the invention improve the circulation of the heated air inside the cooking compartment by redirecting it away from the side walls of the cooking compartment and toward the center of the cooking compartment, which is where the food item being heated is often positioned. Embodiments provide a fin on one or both side walls of the cooking compartment which interrupts the vertical rise of the heated air and redirects it toward the center of the cooking compartment.

Embodiments of the invention improve on other cooking appliances by providing better circulation of the heated air and thus providing a more uniform temperature gradient in the cooking compartment.

Particular embodiments of the invention are directed to a domestic cooking appliance for heating a food item. The domestic cooking appliance includes a main housing; a cooking compartment in the main housing, the cooking compartment being configured to receive the food item to be heated, the cooking compartment having a first sidewall and a second sidewall; a gas burner that provides heat to the cooking compartment; a burner panel located between the gas burner and the cooking compartment; and a first fin protruding from the first sidewall and into the cooking compartment.

Some embodiments include a second fin protruding from the second sidewall and into the cooking compartment.

In some embodiments, the first fin is removably attached to the first sidewall, and the second fin is removably attached to the second sidewall.

Other embodiments of the invention are directed to a domestic cooking appliance for heating a food item. The domestic cooking appliance includes a main housing; a cooking compartment in the main housing, the cooking compartment being configured to receive the food item to be heated, the cooking compartment having a first sidewall and a second sidewall, the first sidewall and the second sidewall being on opposite sides of the cooking compartment; a gas burner that provides heat to the cooking compartment; a burner panel located between the gas burner and the cooking compartment; a first fin protruding from the first sidewall and into the cooking compartment; and a second fin protruding from the second sidewall and into the cooking compartment. The burner panel includes a first opening adjacent to the first sidewall and a second opening adjacent to the second sidewall, and air heated by the gas burner moves into the cooking compartment through the first and second openings. The first fin protrudes from the first sidewall at a first angle, the first angle being less than 70 degrees and more than 20 degrees, and the second fin protrudes from the second sidewall at a second angle, the second angle being less than 70 degrees and more than 20 degrees.

In some embodiments, the first fin is removably attached to the first sidewall, and the second fin is removably attached to the second sidewall.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic oven or other cooking appliance.

Figure 1:
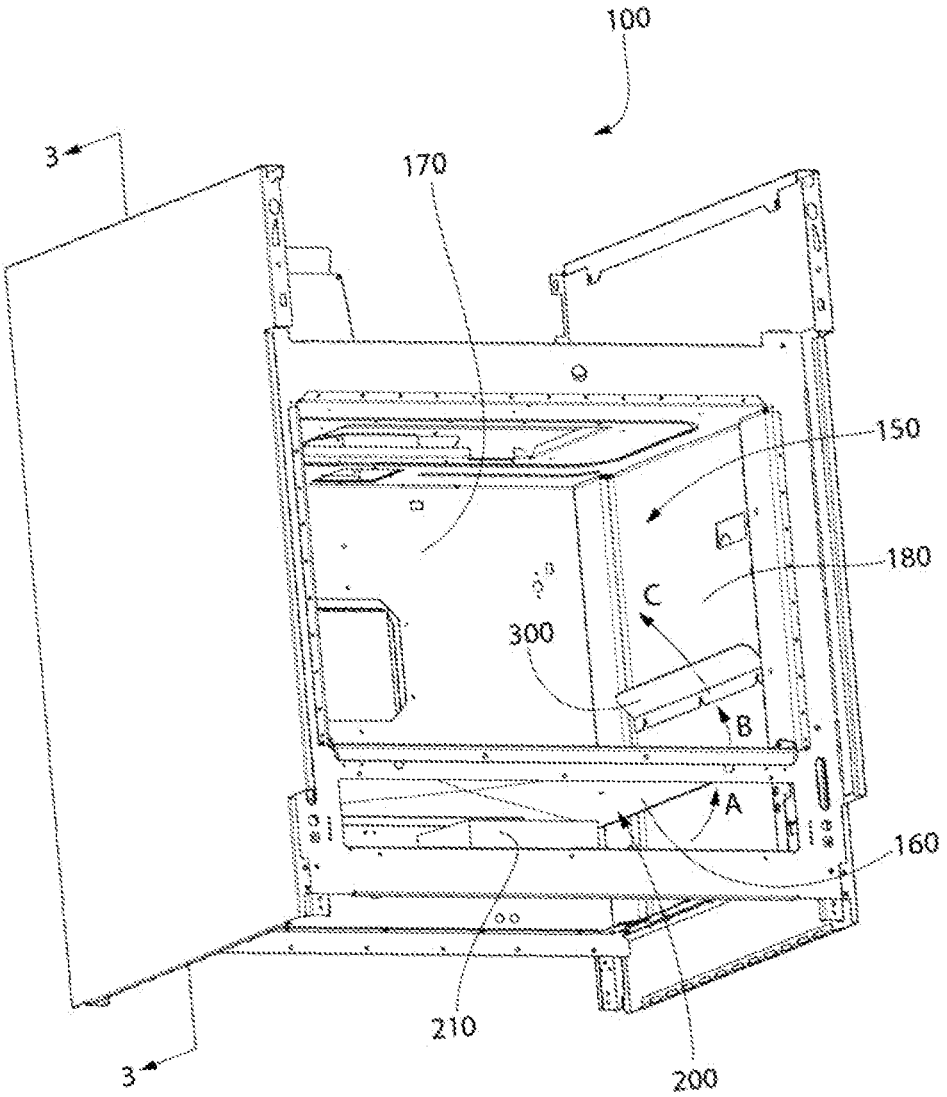
FIG. 1 is a front perspective view of an exemplary appliance in accordance with embodiments of the invention.
Figure 2:
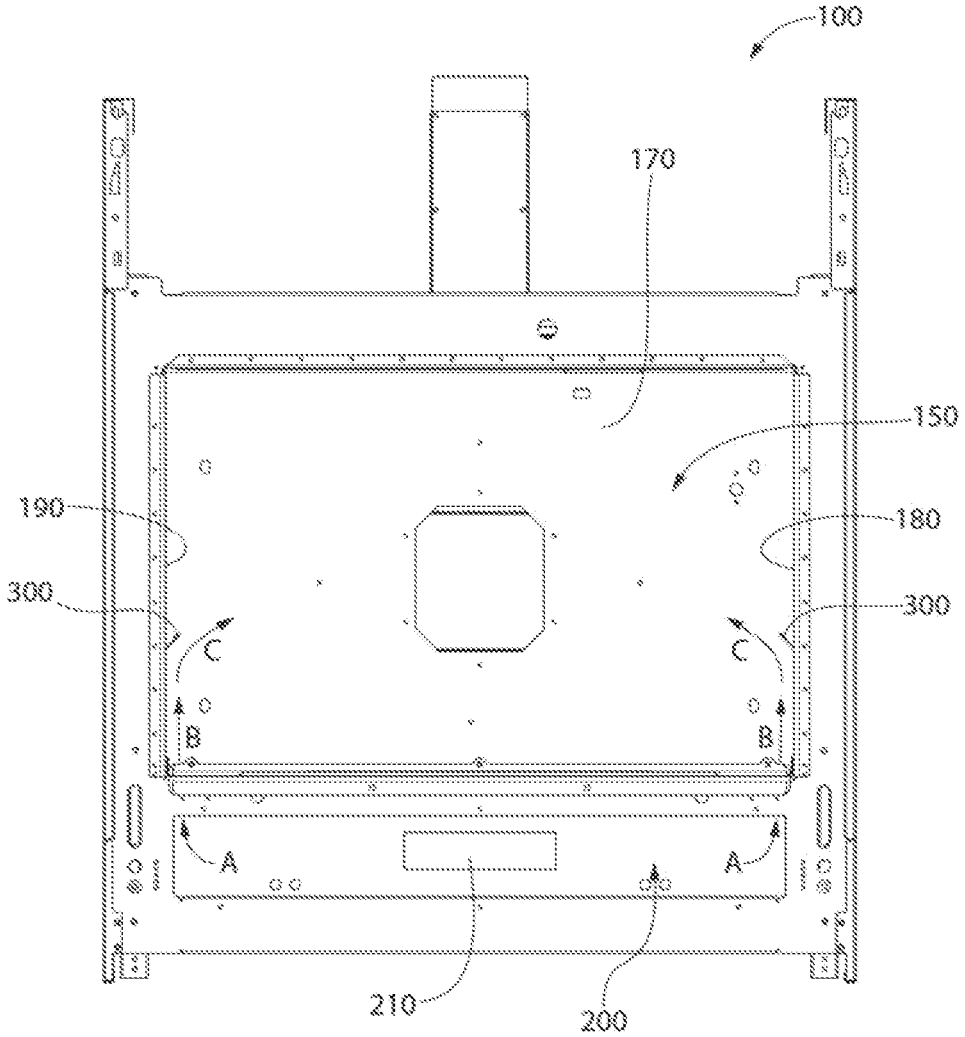
FIG. 2 is a front view of the appliance shown in FIG. 1.

FIGS. 1 and 2 show an example of a gas cooking appliance 100 in accordance with embodiments of the invention. Examples of appliance 100 include ovens and ranges that burn natural gas, propane, and/or other gases to heat a food item. Appliance 100 has, in this example, a main housing and other features that have been omitted, either in whole of in part, for clarity. For example, in some embodiments, appliance 100 includes a cooktop, a second oven, and various other features. Appliance 100 has, in this example, a cooking compartment 150 that has a rear wall 170 and two sidewalls 180, 190. Also shown is a bottom panel 160 positioned between cooking compartment 150 and a burner compartment 200. One or more burners 210 that burn a gas to provide heat to cooking compartment 150 are located in burner compartment 200. Air heated by burner 210 (Arrows A) travels around, in this example, sides of bottom panel 160 panel and into cooking compartment 150 (Arrows B).

In some embodiments, gaps exist between bottom panel 160 and sidewalls 180, 190 to allow heated air A to flow to cooking compartment 150. In some embodiments, bottom panel 160 has openings near sidewalls 180, 190 to allow heated air A to flow to cooking compartment 150. Regardless of the particular configuration of bottom panel 160, heated air A enters cooking compartment 150 at or near sidewalls 180, 190.

After heated air B passes around or through bottom panel 160, it naturally rises toward the top of cooking compartment 150. Without any interference, the heated air tends to continue straight up along sidewalls 180, 190, creating a temperature gradient in cooking compartment 150 that is, in some cases, significantly hotter at the top of cooking compartment 150 than it is in the middle of cooking compartment 150. As the item being cooked is often located on a rack or shelf located in the middle of cooking compartment 150, this temperature gradient is undesirable as compared to a more uniform temperature throughout cooking compartment 150.

Figure 3:
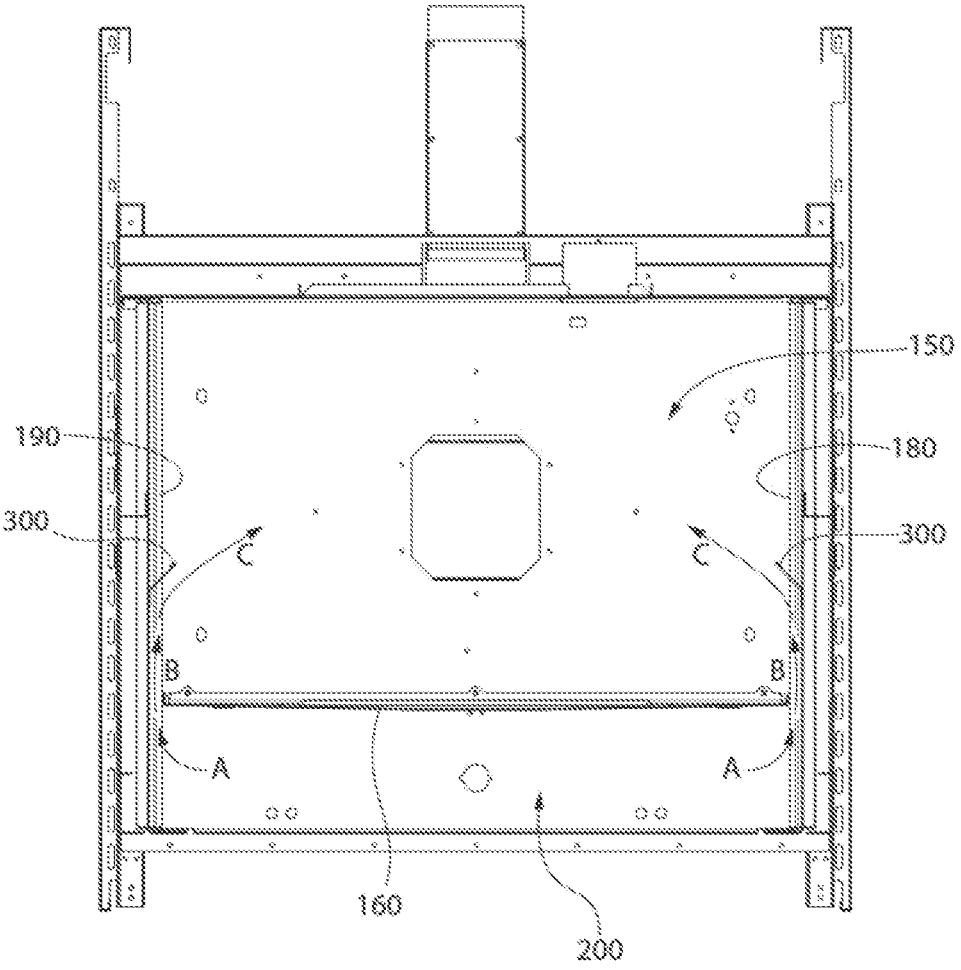
FIG. 3 is a sectional view taken along section line 3-3 in FIG. 1.

As show in FIGS. 1-3, embodiments of the invention include a fin 300 located on one or more walls of cooking compartment 150. In the example shown, one fin 300 is located on each of sidewalls 180, 190. Fins 300 redirect heated air B that passes through bottom panel 160 away from sidewalls 180, 190 and toward the center of cooking chamber 150 (Arrows C). This redirection causes hotter air to reach the center of cooking chamber 150, and thus the food item, than if fins 300 were not in place.

In addition to providing a more uniform temperature existing in cooking chamber 150, embodiments of the invention increase efficiency of appliance 100 because more heat is directed to the food item and less heat is wasted at the top of cooking chamber 150. As a result, less energy is expended in maintaining the desired temperature at the food item. For example, if a temperature of 350 degrees F. is required to cook a food item, 350 degrees F. is required at the center of cooking compartment 150 (where the food item is positioned). Without fins 300 energy is expended to heat the upper part of cooking compartment 150 to a temperature, in some cases, well above 350 degrees F. due to the above-mentioned temperature gradient. In contrast, in embodiments of the invention, the redirecting caused by fins 300 circulates hotter air directly to the center of cooking chamber 150 an, as a result, toward the food item. This redirection also causes a circulation pattern that adds to the more uniform temperature distribution in cooking compartment 150.

While the example shown has one fin 300 on each of sidewalls 180, 190, and provides excellent air circulation, other embodiments provide different numbers and locations of fin 300. For example, in other embodiments, only one fin 300 is provided in cooking compartment 150 on only one of sidewalls 180, 190 or rear wall 170. In other embodiments, one fin 300 is provided on each of sidewalls 180, 190 and rear wall 170, for a total of three fins in cooking compartment 150. While the configurations other than that shown in the Figures are within the scope of the invention, it is noted that such other configurations can result in different circulation patterns of the heated air within cooking compartment 150.

In embodiments, fin 300 is fixed to the respective walls of cooking compartment 150. In other embodiments, fin 300 is removable from the respective walls of cooking compartment 150.

Figure 4:
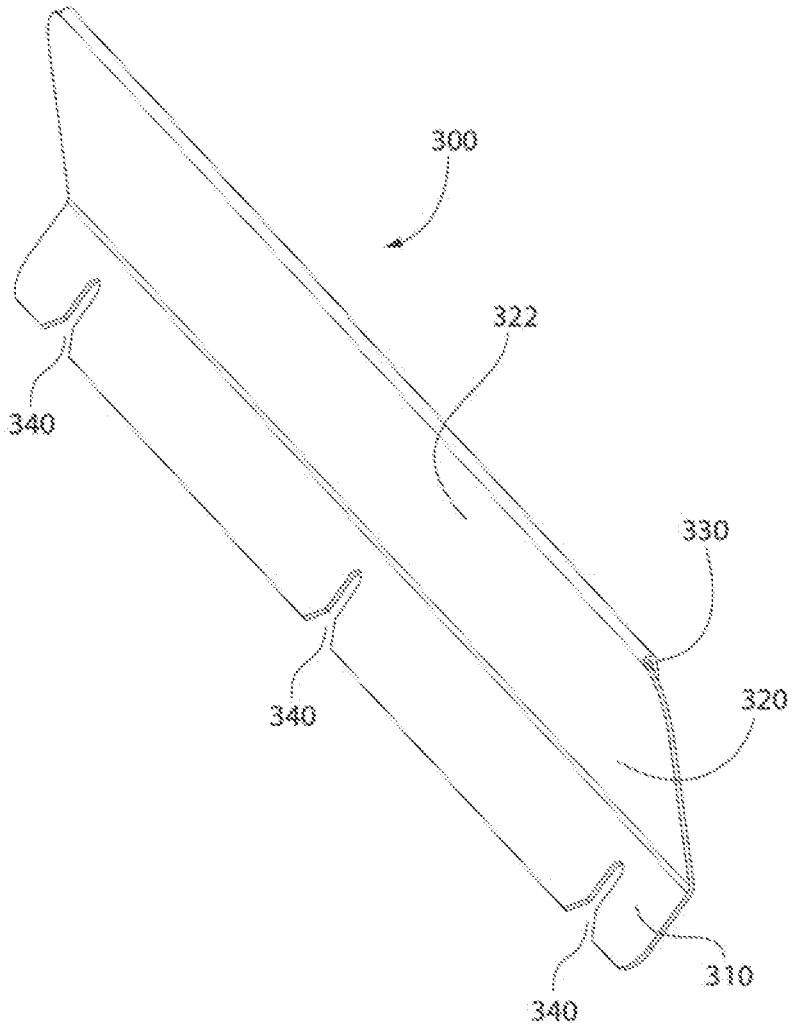
FIG. 4 is a perspective view of a cooking performance fin in accordance with embodiments of the invention.

FIG. 4 shows an example of fin 300 in accordance with embodiments of the invention that is removably attached to sidewalls 180, 190, as shown in FIGS. 1-3. In this example, fin 300 has a base plate 310 and an angled plate 320. Angled plate 320 has a lower surface 322, shares a common edge with base plate 310 and forms an included angle with base plate 310. In embodiments, the included angle is between 110 degrees and 160 degrees. In embodiments, the included angle is between 120 degrees and 150 degrees. In embodiments, the included angle is 135 degrees.

In the embodiment shown, base plate 310 is positioned flush against sidewalls 180, 190, as shown in FIGS. 1-3. This results in the included angle between sidewalls 180, 190 and angled plate 320 being, in the examples listed above, between 20 degrees and 70 degrees, between 30 degrees and 60 degrees, or 45 degrees, respectively. These angles provide the desired redirection of heated air toward the center of cooking compartment 150 depending on the velocity of heated air B contacting fin 300. In embodiments, an included angle of 45 degrees with sidewalls 180, 190, and the vertical location of fins 300 on sidewalls 180, 190 shown in FIGS. 1-3 provide the desired redirection in a domestic oven with normal heating capability.

FIG. 4 shows three notches 340 in base plate 310. Notches 340 allow fin 300 to slide over lugs 400 (shown in FIG. 9) to be removably attached to sidewalls 180, 190, allowing toolless removal of fin 300. It is beneficial for fin 300 to be removable from sidewalls 180, 190 for several reasons. For example, fin 300 can be more easily cleaned outside of appliance 100 in, for example, a sink or dishwasher. Also, cooking debris can collect in the space between angled plate 320 and sidewalls 180, 190 (the included angle). In some embodiments, fin 300 is a material (such as stainless steel) that can be discolored by heat during self-cleaning operations in pyrolytic self-cleaning ovens.

The example shown in the Figures has a fold 330 at the edge of angled plate 320 that is opposite base plate 310. Fold 330 provides a rounded edge for strength and safety. Also, in this embodiment, fold 330 is folded away from lower surface 322 in order to provide a smooth, unobstructed lower surface 322 for more efficiently redirecting the heated air. In addition, placing fold 330 above angled plate 320, as opposed to below angled plate 320, reduces deposits in fold 330 from the heated air.

Figure 5:
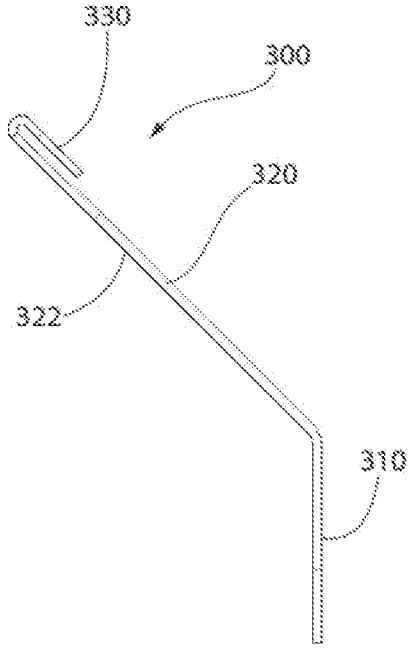
FIG. 5 is an edge view of the cooking performance fin shown in FIG. 4.
Figure 6:
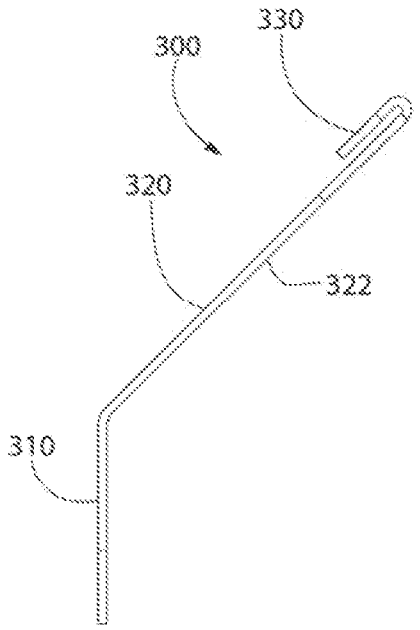
FIG. 6 is an edge view of the cooking performance fin shown in FIG. 4.

FIGS. 5 and 6 clearly show fold 330 and the angle between base plate 310 and angled plate 320 of fin 300. FIG.

Figure 8:
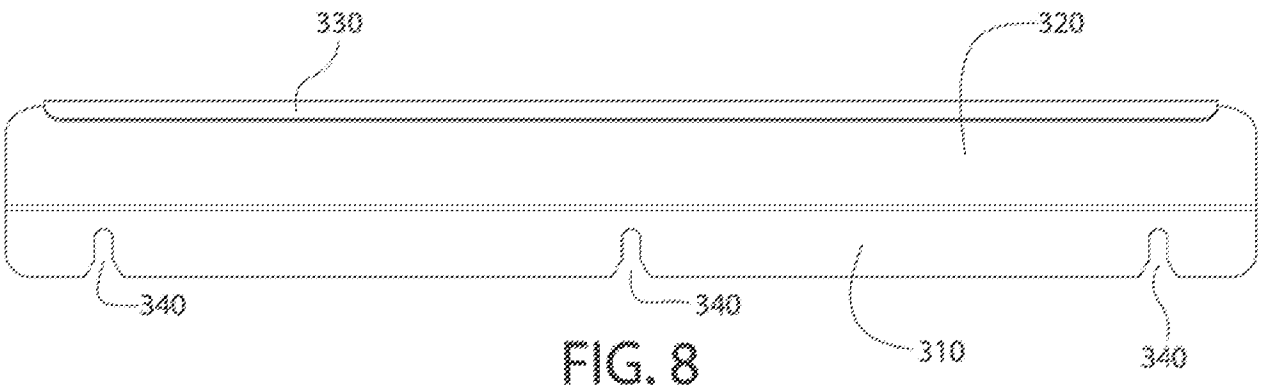
FIG. 8 is a rear view of the cooking performance fin shown in FIG. 4.

7 is a front view of fin 300 looking from within cooking compartment 150. FIG. 8 is arear view of fin 300 showing fold 330.

Figure 7:
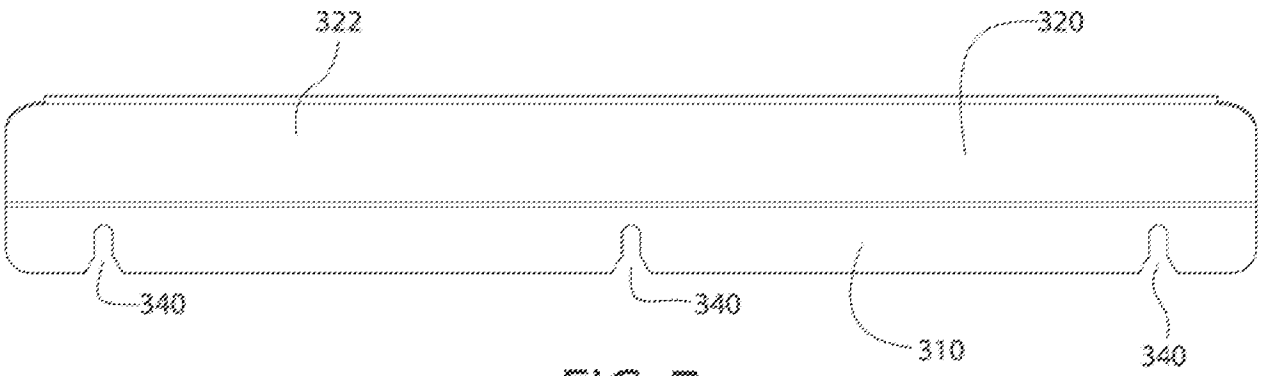
FIG. 7 is a front view of the cooking performance fin shown in FIG. 4.
Figure 9:
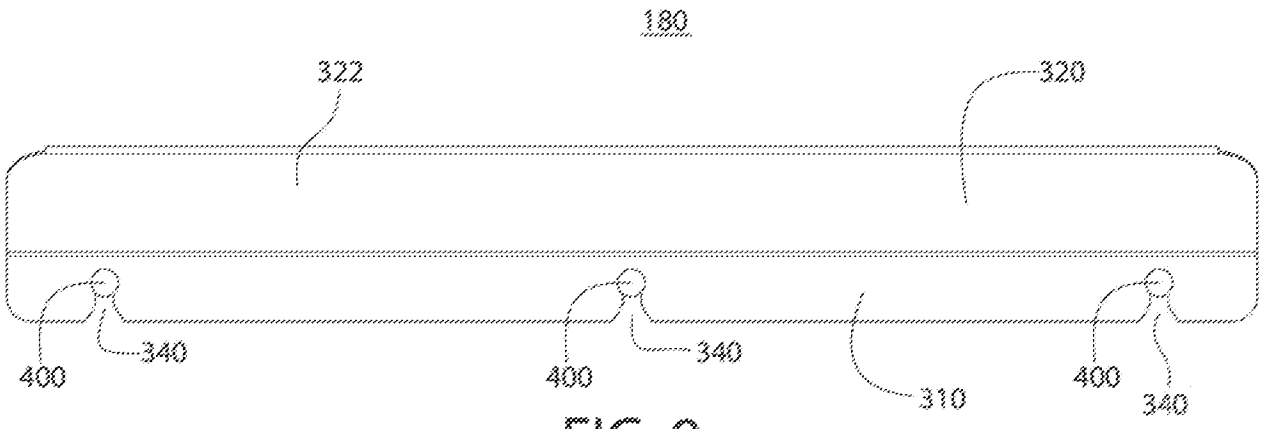
FIG. 9 is a front view of the cooking performance fin shown in FIG. 4 in an operating position in a cooking appliance.

FIG. 9 is a front view of fin 300 installed on wall 180. Three lugs 400 can be seen in notches 340. Comparing FIG. 9 to FIG. 7 shows that a head of each lug 400 prevents fin 300 from sliding off of lug 400 and away from sidewall 180. This is because the head of lug 400 is larger than the upper part of notch 340. While three lugs 400 and three notches 340 are shown in the Figures, fewer or more lugs and notches can be used. Further, other attachment methods can be used to removably attach fin 300 to sidewall 180.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic cooking appliance for heating a food item, comprising:

a main housing;

a cooking compartment in the main housing, the cooking compartment being configured to receive the food item to be heated, the cooking compartment having a first sidewall and a second sidewall, the first sidewall and the second sidewall being on opposite sides of the cooking compartment;

a gas burner that provides heat to the cooking compartment;

a burner panel located between the gas burner and the cooking compartment;

a first fin protruding from the first sidewall and into the cooking compartment; and a second fin protruding from the second sidewall and into the cooking compartment, wherein the burner panel comprises a first opening adjacent to the first sidewall and a second opening adjacent to the second sidewall, and air heated by the gas burner moves into the cooking compartment through the first and second openings, the first fin protrudes from the first sidewall at a first angle, the first angle being less than 70 degrees and more than 20 degrees, and the second fin protrudes from the second sidewall at a second angle, the second angle being less than 70 degrees and more than 20 degrees, wherein the first fin is removably attached to the first sidewall, and the second fin is removably attached to the second sidewall.

2. The domestic cooking appliance of claim 1, further comprising a plurality of first lugs protruding from the first sidewall toward the cooking compartment, wherein the first fin comprises a base plate and an angled plate, the angled plate extending from the base plate at the first angle and having a common edge with the base plate, the first fin further comprises a plurality of notches in the base plate, each of the notches receiving one of the first lugs.

3. The domestic cooking appliance of claim 2, wherein the second fin is identical to the first fin.

* * * * *